United States Patent [19]

Bruce

[11] Patent Number: 4,846,279

[45] Date of Patent: Jul. 11, 1989

[54] METHOD AND MEANS FOR INTRODUCING TREATMENT FLUID INTO A WELL BORE

[75] Inventor: Charles R. Bruce, Littleton, Colo.

[73] Assignee: Marathon Oil Company, Findlay, Ohio

[21] Appl. No.: 143,990

[22] Filed: Jan. 13, 1988

[51] Int. Cl.[4] ..... E21B 37/06; E21B 41/02

[52] U.S. Cl. ..... 166/310; 166/117; 166/162; 166/371; 166/902

[58] Field of Search ..... 166/310, 162, 165, 169, 166/117, 902, 371, 370, 300

[56] References Cited

U.S. PATENT DOCUMENTS

| | | | |
|---|---|---|---|
| 2,635,996 | 4/1953 | Rohrback et al. | 252/8.55 |
| 2,642,139 | 6/1953 | Bedford | 166/310 X |
| 2,690,806 | 11/1954 | Britton et al. | 166/42 |
| 2,717,651 | 9/1955 | Rohrback | 166/310 X |
| 2,760,584 | 8/1956 | Rohrback | 166/310 X |
| 2,852,080 | 9/1958 | Roach | 166/310 X |
| 2,859,827 | 11/1958 | Elkins et al. | 166/165 |
| 2,928,471 | 3/1960 | Jones | 166/162 |
| 2,931,309 | 4/1960 | Bower | 103/148 |
| 2,968,351 | 1/1961 | Jones | 166/162 |
| 2,993,542 | 7/1961 | Schremp | 166/310 X |
| 3,020,961 | 2/1962 | Orr | 166/165 |
| 3,104,715 | 9/1963 | Robinson, Jr. et al. | 166/162 |
| 3,104,716 | 9/1963 | Burkhardt et al. | 166/310 X |
| 3,199,596 | 8/1965 | Wood | 166/117 X |
| 3,865,108 | 2/1975 | Hartop | 128/260 |
| 3,995,632 | 12/1976 | Nakano et al. | 128/260 |
| 4,064,941 | 12/1977 | Smith | 166/162 X |
| 4,207,893 | 6/1980 | Michaels | 128/260 |
| 4,291,763 | 9/1981 | Singer | 166/169 X |
| 4,340,054 | 7/1982 | Michaels | 128/260 |
| 4,350,271 | 9/1982 | Eckenhoff | 222/386.5 |
| 4,421,166 | 12/1983 | Cain | 166/162 |
| 4,424,862 | 1/1984 | Munari et al. | 166/168 |
| 4,454,914 | 6/1984 | Watanabe | 166/310 X |

*Primary Examiner*—Hoang C. Dang

*Attorney, Agent, or Firm*—Jack L. Hummel; Rodney F. Brown

[57] ABSTRACT

Treatment fluid is injected into the production fluid of a well from a bladder contained in a canister at the bottom portion of the well bore. The flow rate is predetermined through use of a capillary tube connecting the bladder and an injection outlet. Differential pressure between the bladder and the outlet to actuate the flow of treatment fluid is created either by restricting the flow of production fluid adjacent the outlet or by compressing the bladder through the use of water-expansible material in contact with the bladder in the canister. An aperture in the bottom of the canister is provided to expose the bladder to the well fluid.

9 Claims, 2 Drawing Sheets

METHOD AND MEANS FOR INTRODUCING TREATMENT FLUID INTO A WELL BORE

FIELD OF THE INVENTION

This invention relates broadly to the introduction of treatment fluid into a well bore. More particularly, it relates to a method and means for making use of the well fluid itself to cause treatment fluid to be injected into the production zone of the well.

BACKGROUND OF THE INVENTION

It is often necessary to introduce treatment chemicals into fluid producing wells in order to correct or prevent certain undesirable conditions. Corrosion or scale inhibitors, for example, have been introduced in a variety of ways in both solid and liquid form. One method of introduction involves pumping or pouring chemicals in liquid form down the tubing string or the production string, or through separate strings of tubing inserted into the well bore for that purpose. Although chemicals in liquid form can be readily mixed with the flow of production fluids and can be readily pumped or poured at controlled rates, there are serious disadvantages to the use of these treatment methods. The use of additional strings of tubing is expensive and runs the risk of interfering with other operations of the well, while the pumping or pouring of liquid chemicals from the surface down into the well can require an excess of chemicals to be introduced, at a correspondingly higher cost, in order to ensure adequate distribution throughout the well.

Both solid and liquid treatment compositions have also been introduced from containers which are filled with chemicals on the surface and lowered into the well. A number of ways have been suggested for introducing the chemicals into the production fluid from the containers. Containers which are degradable by the treatment composition or by the well fluid have been used. While overcoming some of the objections to the continuous pumping or pouring of liquid chemicals referred to above, there are distinct disadvantages to this approach as well. Some methods of introducing the containers and releasing the chemicals require temporary interruption of well production, while most methods of chemical release are not able to continuously inject controlled amounts of treatment chemicals into the production fluid. The result has been the introduction of chemicals basically in the form of a batch treatment process, with accompanying lack of adequate control over the operation.

Although one method of introducing chemicals from a container, described in U.S. Pat. No. 2,635,996, involves a relatively slow continuous release into the production fluid, this method is able to introduce chemicals only over a relatively short period of time, such as 24 hours. Thus this method in effect constitutes simply another variation of a batch-type introduction process. Moreover, it requires the use of a chemical composition in solid form, which is not preferred from the standpoint of its ability to readily mix with the production fluid and the ability to control the rate at which the chemicals are introduced.

Another way of introducing liquid treatment chemicals involves the use of containers which incorporate various types of arrangements for causing the release of chemicals carried by the containers. For example, pistons, bellows, pumps and the like have been incorporated in the design of containers for injecting or pumping treatment liquid into the well. While enabling some control over the rate at which the liquid is introduced, these mechanical arrangements are generally relatively complicated in design, resulting in costly containers, a higher probability of failure than desired and a relatively short operating life.

It would be desirable to be able to introduce chemical treatment fluids into a well bore from a container in an accurate, controlled and reliable manner, and to do so with a system which is simple, uncomplicated and inexpensive. Further, it would be highly desirable to be able to accomplish the foregoing with a system which can introduce treatment fluids over a relatively long period of time.

BRIEF SUMMARY OF THE INVENTION

This invention utilizes a bladder contained in a canister which is located in the bottom portion of a well bore. The bladder has an opening in its upper portion connected to injection means, the outlet of which is located above the lowermost production perforation in the well bore. Means are provided for creating a sufficient pressure differential between the injection outlet and the interior of the bladder to cause treatment fluid to flow from the bladder through the injection outlet and into the production fluid in the well bore. The rate of injection may be controlled by employing a capillary tube connecting the bladder and the injection outlet.

The pressure differential is created by making use of the well fluid itself to initiate and continue the injection process. In one embodiment the flow of production fluid is restricted adjacent the injection outlet to cause a reduction in pressure in that area, thereby enabling the greater pressure in the bladder to cause treatment fluid to flow to the injection means and out the injection outlet. In another embodiment the canister also contains material which expands upon being moistened by the well fluid, thus compressing the bladder to force treatment fluid to flow to the injection means.

Because the canister can be made quite long, limited in practice only by the length which can conveniently be loaded into the well through the lubricator chamber, the time it takes for the treatment fluid to be fully exhausted from the bladder can readily extend over a period of months. The rate at which the treatment fluid is injected into the production fluid of the well can be controlled by proper selection of the inside diameter of the capillary metering tube. The device is simple in design with little risk of failure, so that it can be installed in a well bore with expectations that it will perform satisfactorily for its entire design life.

Other features and aspects of the invention, as well as its various benefits, may be ascertained from the more detailed description of the invention which follows:

DESCRIPTION OF THE PREFERRED EMBODIMENTS

Figure 1:
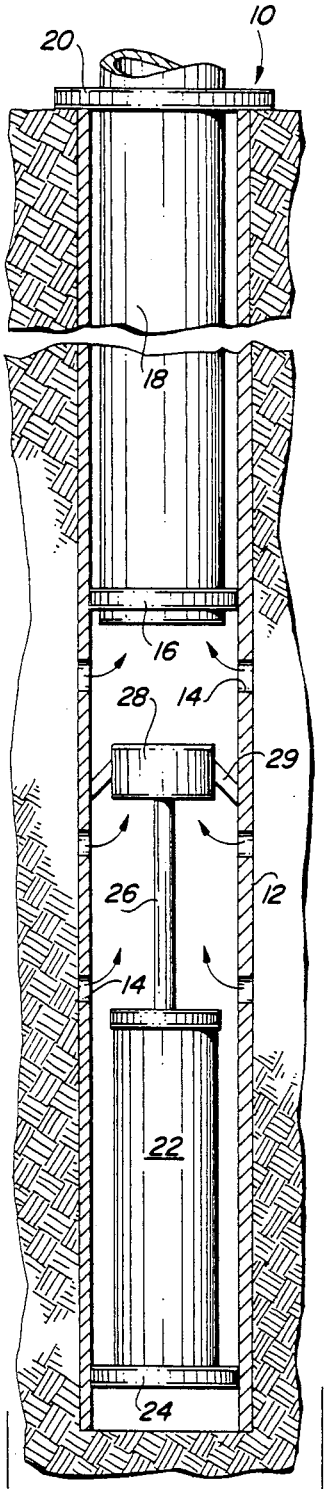
FIG. 1 is a partial longitudinal sectional view schematically showing a fluid well bore incorporating the fluid treatment device of the present invention.

Referring to FIG. 1, a well bore 10 includes a casing 12 containing production perforations 14. A packer 16 located above the perforations 14 seals the annular space between the casing 12 and the tubing string 18. The top end of the well terminates in the well head 20, and although it is understood that other equipment common to well bore installations is connected above the well head, such equipment is not shown since it does not form a part of the invention. The canister utilized in the invention is indicated at 22 in the bottom portion of the well bore after it has been lowered into place, as for example by a wire line. The canister is shown as being held in place a short distance above the bottom of the well bore by a suitable packer 24. A fluid conduit or tube 26 extends upwardly from the top of the canister 22 and is connected to a fluid injection head 28 located above the lowermost production perforation in the zone of production fluid flow. The canister itself would normally be below the lowermost production perforation but may in certain circumstances be located higher in the well bore, as explained further below.

Figure 2:
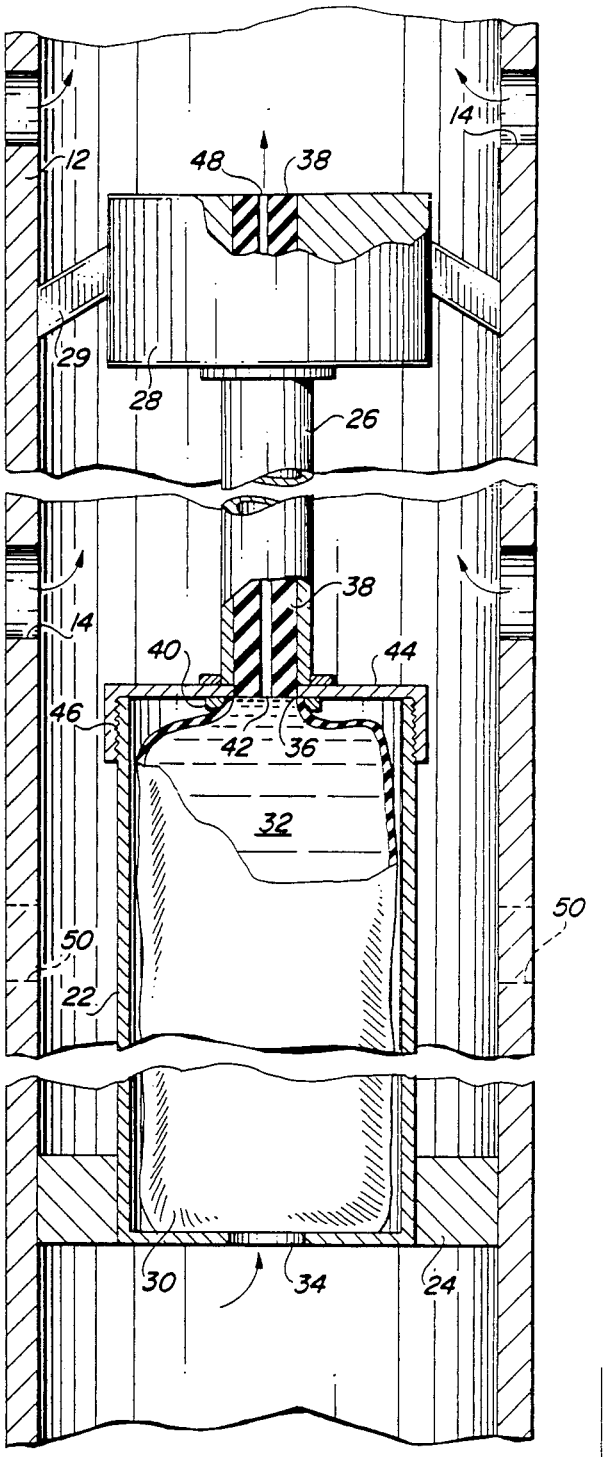
FIG. 2 is an enlarged partial longitudinal sectional view of one, embodiment of the fluid treatment device illustrated in FIG. 1.

A preferred embodiment of the invention is illustrated in more detail in FIG. 2, wherein the canister 22 can be seen to contain a bladder 30 filled with liquid inhibitor or other type of treatment fluid 32 desired to be introduced into the production fluid of the well. The bladder may be comprised of any suitable flexible material which can be formed into a fluid-tight bladder, such as, for example, KAPTON polyimide polymer having a thickness in the range of 6–8 mils. The bladder may also be provided with a TEFLON coating if desired. Both KAPTON and TEFLON are trademarks of E. I. Du Pont de Nemours and Co. of Wilmington, Delaware. The canister may be fabricated from titanium or stainless steel or any other material that can resist the physical stresses to which the canister is exposed and also resist attack from corrosive well fluids.

The bottom of the canister contains at least one aperture 34 through which well fluid may enter, thereby subjecting the bladder 30 to the fluid pressure existing at the bottom portion of the well bore. Although a single aperture is shown at the center of the bottom wall of the canister, it should be understood that a number of apertures may be provided instead. Also, if desired, instead of being located in the bottom wall apertures may be provided in the lower portion of the side wall of the canister.

The upper portion of the bladder 30 contains an opening 36 which surrounds the lower end of a capillary tube 38. The bladder 30 may be tightly connected to the lower end of the capillary tube by any suitable means, such as by a clip 40. The inside diameter or conduit 42 of the capillary tube 38 may be any suitable size in the capillary range, such as, for example, 1 mm. It will be understood by those skilled in the art that the rate at which treatment fluid 30 flows through the tube 38 may be controlled for any given pressure differential through selection of various diameters and lengths of capillaries.

For purposes of illustration the upper wall of the canister is shown as comprising a removable cap or cover 44 which may be attached by any suitable means, such as by threaded connection 46, to the upper end of the canister walls. By this arrangement the bladder may be inserted into the open upper end of the canister and filled with treatment fluid, after which the cap may be attached. The canister may be formed as an integral unit or may be comprised of a number of separate lengths connected together in any suitable manner well known in the art. If formed of separate lengths the bladder could be inserted just prior to the attachment of the uppermost length, which would make unnecessary the provision of a cap member.

The capillary tube 38 is sheathed inside the tube 26 and extends up beyond the tube 26 into the injection head 28 which surrounds it. The tube 26 and the injection head 28 may be formed of the same material used to fabricate the canister 22 or from any other suitable material having similar properties. The conduit 42 of the capillary tube terminates at the top of the injection head 28 and constitutes the outlet 48 of the injection head. The injection head is preferably of cylindrical shape and extends radially outwardly toward the casing 12 a distance such that the transverse cross-sectional area of the injection head is a significant fraction of the transverse cross-sectional area of the well bore. By way of illustrative example, an injection head located in a 7 inch casing may typically be 6.75 inches in diameter. If the tubing diameter does not allow insertion of an injection head of such large diameter through the tubing, an expansion device, such as umbrellalike vanes adapted to open outwardly from the injection head, can be used to restrict flow and obtain the desired pressure drop. Because such a device is well within the ability of one skilled in the art to provide, the details of the expansion device are not described herein.

In operation, a canister containing a bladder 30 filled with treatment fluid is lowered into place at the bottom of the well bore. The canister may be of any desired size limited only by the length of the lubricator chamber in which it normally would be inserted in order to lower it into place. Typically, the canister would be about 40 feet long and would utilize a capillary tube about 10 feet in length, allowing the assembly to be readily inserted into the well bore so that the canister is below the lowermost production perforation and the injection outlet is above it. It will be understood that flow of production fluid through the production perforations 14 will be sufficiently restricted by the presence of the injection head 28 in the flow path to cause a pressure drop adjacent the outlet 48 so that the pressure differential between the well fluid at the bottom aperture 34 of the canister and the production fluid at the injection outlet 48 is sufficient to cause treatment fluid to flow from the bladder through the injection outlet and into the production fluid. Because the injection rate of the treatment fluid is controlled by the flow rate permitted by the capillary tube, selection of the capillary tube size determines the injection rate. The combination of a large size canister and bladder assembly with controlled flow rates of treatment fluid, for example, in the order of $1\frac{1}{2}$ gallons of fluid per day, can result in an effective service life for the assembly of several months.

If it is found that the flow rate could advantageously be restricted even further in order to provide a greater pressure drop, the canister could be set at a higher point in the well bore so that the upper portion of the canister extends above the lowermost production perforation in the casing. This arrangement is suggested in FIG. 2, wherein the perforations 50, shown in dotted lines, represent the lowermost production perforations. Thus the upper portion of the canister would lie in the production fluid flow zone and thereby act to restrict flow and contribute to the pressure drop.

Figure 3:
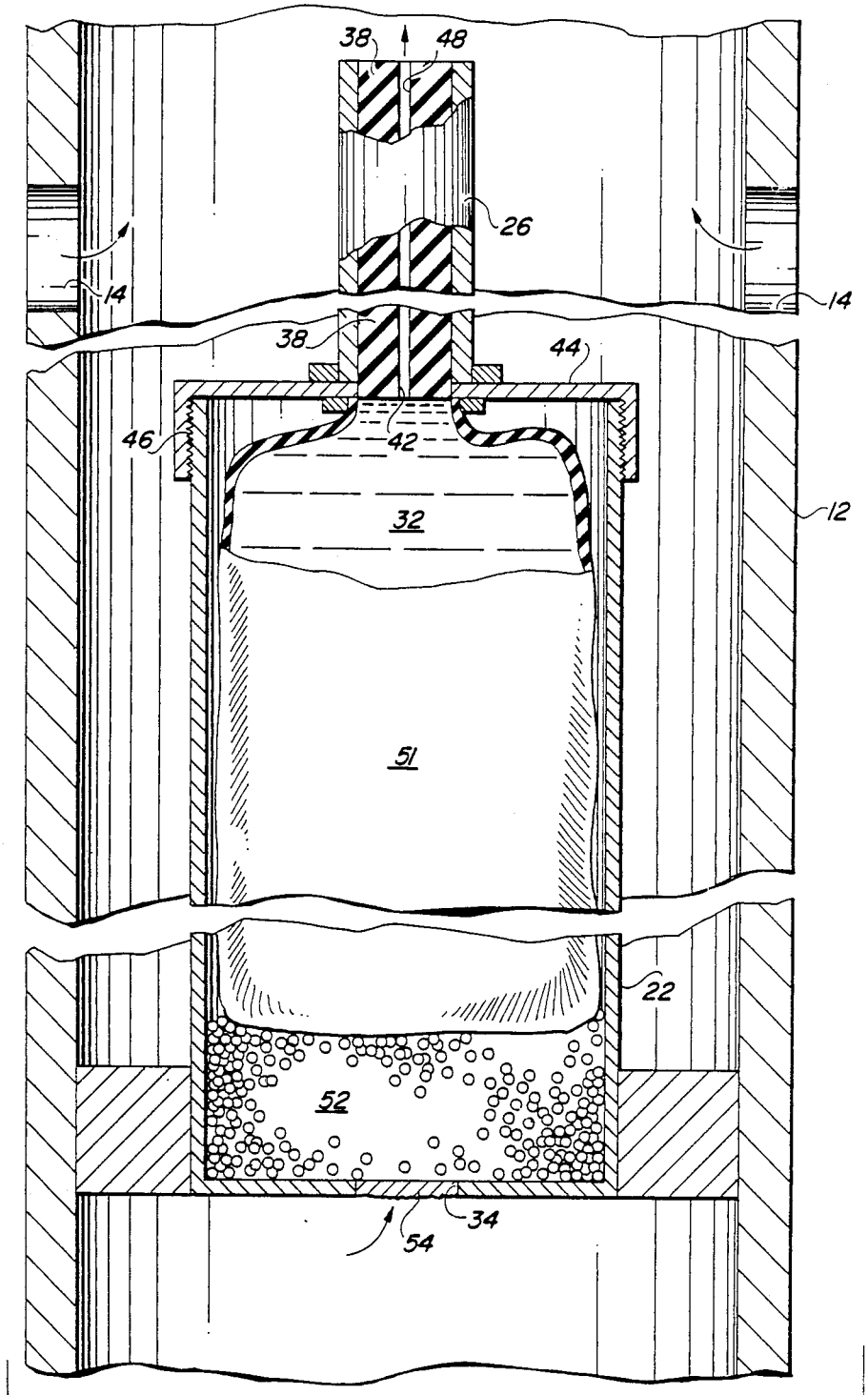
FIG. 3 is an enlarged partial lnngitudinal sectional view of another embodiment of the fluid treatment device illustrated in FIG. 1.

Referring now to FIG. 3, wherein like reference numerals to those of FIG. 2 denote like elements, a second embodiment of the invention is illustrated. In this embodiment a canister is situated in the well bore similar to the canister arrangement of FIG. 2. Instead of employing a bladder that substantially fills the interior of the canister, however, the bladder 51 is spaced from the bottom of the canister and the space is filled with a substance 52 which inherently expands or swells upon being moistened. There are many materials which have this property and which can be used, an example being compressed dehydrated cellulosic material such as grains of wheat or rice. To prevent the well fluid from contacting and expanding the material prematurely, suitable means indicated generally at 54 can be provided to seal the aperture 34 in the bottom of the canister until the canister is set in place. Examples of such means are an aluminum foil cover which would be corroded away by the well fluid, or a low melting temperature wax cover or plug which would melt when exposed for a period of time to the high temperatures at the bottom of the well bore.

In operation, the canister is filled and lowered into place as described in connection with the first embodiment. After the seal 54 has been destroyed well fluid enters the canister through the aperture 34 and contacts the expansible material 52, causing it to swell. This action compresses the bladder 50, producing a sufficient pressure differential between the treatment fluid in the bladder and the production fluid at the outlet 48 to result in the flow of treatment fluid 32 through the capillary tube 38 and out the injection outlet 48 into the production fluid. As in the first embodiment, the rate of flow through the injection outlet 48 would be controlled by the dimensions of the capillary tube 38. Because the compression of the bladder creates an adequate pressure differential without having to restrict the flow of production fluid adjacent the injection outlet, it is not necessary to provide flow restricting means. Therefore the top of the capillary tube 38 may simply be supported in the rigid tube 26 without the need for additional structure.

The size of the bladder and the amount of expansible material required are functions of the expansion ratio of the material. For example, if the compressed dehydrated cellulosic material has a ratio of expansion of 20:1, approximately 5% of the volume of the canister would be filled with the expansible material. Thus upon complete expansion substantially the entire volume of the canister would be filled with the expanded material, with the empty bladder occupying only a minor amount of space.

Although the capillary tube has been shown in both embodiments of the invention as directly connecting the outlet of the bladder to the outlet of the injection head, it should be understood that the invention is not limited to this specific physical arrangement. The injection device would function in the same manner if the capillary tube were merely a part of the conduit connecting the bladder to the injection head outlet. For example, a relatively large diameter tube could connect the bladder to a capillary tube of desired length and diameter coiled inside the injection head. The capillary tube would thus connect the large diameter tube to the injection head outlet but would not comprise the entire conduit connecting the bladder to the injection head outlet.

As to the location of the expansible material in the canister in the FIG. 3 embodiment, the material need not be restricted to the space between the bottom of the bladder and the bottom of the canister as shown in the drawing. The device would obviously function just as well if the bladder were spaced from the side walls of the canister and the expansible material wire located between the bladder and the side walls. Such an arrangement could be used instead of or in addition to the arrangement shown in FIG. 3.

It should now be clear that the present invention, regardless of which embodiment is used, results in a simple reliable fluid introduction device which makes use of the well fluid itself to actuate the flow. Thus the unit is self-contained and does not require outside control. The rate of injection of treatment fluid into the production fluid is controlled by selecting capillary tube dimensions which produce the desired flow. The necessary pressure differential is achieved in either case by making use of the fluid flow in the well. If a greater pressure differential is desired, or if it is preferred to make use of a pressure differential which does not have to depend on flow conditions in the well, the positive pressure means of the second embodiment may preferably be used.

It should now be obvious that in addition to the modifications suggested herein, other changes which do not affect the overall operation of the injection device may be made to the described embodiments without departing from the spirit and scope of the invention, as defined in the appended claims.

What is claimed is:

1. A device for introducing treatment fluid into a well bore containing a casing having perforations through which production fluid from the surrounding formation may flow, the device comprising:

a canister in the bottom portion of the well bore;

the canister containing a bladder filled with treatment the bladder having an opening in its upper portion;

injection means connected to the opening in the bladder, the injection means having an outlet located above the opening in the bladder and above the lowermost operative production perforation in the casing, the outlet being exposed to the flow of production fluid;

the injection means outlet being connected to the opening in the bladder through a capillary metering tube for controlling the rate at which treatment fluid is injected into the production fluid;

aperture means in the canister for allowing the entry of well fluid, the canister being sealed against the entry of fluids other than well fluid; and means dependent upon the presence of well fluid in the canister for creating a sufficient pressure differential between the injection outlet and the interior of the bladder whereby treatment fluid is caused to flow from the bladder through the injection outlet and into the production fluid in the well bore.

2. The device according to claim 1, wherein means for creating a pressure differential further comprises means for restricting the flow of production fluid adjacent the injection means outlet.

3. The device according to claim 2, wherein the means for restricting the flow of production fluid adjacent the injection means outlet comprises a head portion surrounding the injection means outlet, the transverse cross-sectional area of the head portion being of such size compared to the transverse cross-sectional area of the bore of the casing as to produce a significant pressure drop from the interior of the bladder to the injection means outlet.

4. The device according to claim 3, wherein the canister has a top portion located above the lowermost production perforation in the casing, the tansverse cross-sectional area of said top portion being of such size as to assist the head portion of the injection means in producing a significant pressure drop from the interior of the bladder to the injection means outlet.

5. A device for introducing treatment fluid into a well bore containing a casing having perforations through which production fluid from the surrounding formation may flow, the device comprising:

a canister in the bottom portion of the well bore;

the canister containing a bladder filled with treatment fluid;

the bladder having an opening in its upper portion;

injection means connected to the opening in the bladder, the injection means having an outlet located above the lowermost perforation in the casing;

means for creating a sufficient pressure differential between the injection outlet and the interior of the bladder whereby treatment fluid is caused to flow from the bladder through the injection outlet and into the production fluid in the well bore, said means comprising aperture means in the canister for allowing the entry of well fluid and material in the canister for compressing the bladder which expands upon being moistened by the well fluid.

6. The device according to claim 5, wherein the means in the canister for compressing the bladder comprises compressed dehydrated cellulosic material having a high expansion ratio.

7. A method of introducing treatment fluid into a well bore containing a casing having perforations through which production fluid from the surrounding formation may flow, the method comprising the steps of:

locating a bladder containing treatment fluid in the bottom portion of the well bore;

connecting the interior of the bladder to an injection outlet located above the bladder and above the lowermost operative production perforation in the casing, the injection outlet being exposed to the flow of production fluid;

metering the flow of treatment fluid from the bladder to the injection outlet through a capillary tube the inside diameter of which has been selected to provide a predetermined rate of flow into the production fluid; and creating a sufficient pressure differential between the injection outlet and the interior of the bladder to cause treatment fluid to flow from the bladder through the injection outlet and into the production fluid in the well bore by exposing the bladder to the pressure of well fluid and restricting the flow of production fluid adjacent the injection outlet to an extent which substantially reduces the pressure in the production fluid at the injection outlet, the canister being sealed against the entry of fluids other than well fluid.

8. A method of introducing treatment fluid into a well bore containing a casing having perforations through which production fluid from the surrounding formation may flow, the method comprising the steps of:

locating a canister having a bladder containing treatment fluid therein in the bottom portion of the well bore;

connecting the interior of the bladder to an injection outlet located above the lowermost production perforation in the casing; and introducing well fluid into the canister and compressing the bladder in response to the presence of moisture in the canister, said moisture causing an expansible material in the canister to expand thereby compressing the bladder to create sufficient pressure differential between the injection outlet and the interior of the bladder to cause treatment fluid to flow from the bladder through the injection outlet and into the production fluid in the well bore.

9. The method according to claim 8, wherein the expansible material comprises compressed dehydrated cellulosic material having a high expansion ratio.

* * * * *

UNITED STATES PATENT AND TRADEMARK OFFICE

CERTIFICATE OF CORRECTION

PATENT NO. : 4,846,279

DATED : July 11, 1989

INVENTOR(S) : Charles R. Bruce

It is certified that error appears in the above-identified patent and that said Letters Patent is hereby corrected as shown below:

Col. 2, line 64: After "one" delete ",".
Col. 2, line 66: Delete "Inngitudinal" and insert --longitudinal--.
Col. 6, line 38: After "treatment" insert --fluid;--.

Signed and Sealed this

Eighth Day of May, 1990

*Attest:*

HARRY F. MANBECK, JR.

*Attesting Officer*

*Commissioner of Patents and Trademarks*